United States Patent [19]

Suzuki et al.

[11] 4,298,652

[45] Nov. 3, 1981

[54] METHOD OF PRODUCING MEDIUM-GRADE COATED PAPER FOR ROTOGRAVURE PRINTING

[75] Inventors: Kuzuhiko Suzuki, Nishinomiya; Yasuhiro Fujiki, Ibaraki; Tojiro Kitahori, Kawanishi; Akira Takada, Kobe, all of Japan

[73] Assignee: Kanzaki Paper Mfg. Co., Ltd., Tokyo, Japan

[21] Appl. No.: 147,825

[22] Filed: May 8, 1980

[30] Foreign Application Priority Data

May 11, 1979 [JP] Japan ..... 54-58327

[51] Int. Cl.[3] ..... B32B 23/08; B32B 27/10; D21H 1/28

[52] U.S. Cl. ..... 428/323; 427/391; 428/342

[58] Field of Search ..... 428/323, 342; 427/391

[56] References Cited

U.S. PATENT DOCUMENTS

| | | | |
|---|---|---|---|
| 4,046,946 | 9/1977 | Shaw | 428/342 |
| 4,064,304 | 12/1977 | Fujita et al. | 428/342 |
| 4,258,104 | 3/1981 | Lee et al. | 428/342 |

*Primary Examiner*—William J. Van Balen

[57] ABSTRACT

A method of producing medium-grade coated paper for rotogravure printing, which paper, when printed, has fewer missing gravure dots and reproduction of gravure dots is improved.

The method comprises applying the following coating composition (A) or (B) to either surface or both surfaces of base paper, the fiber content of which comprises 10 to 100 parts, by weight, high-yield pulp(s) having a 42-mesh fiber fraction content of below 30%, and 0 to 90 parts, by weight, chemical pulp(s): The coating composition (A) comprises pigments containing natural ground calcium carbonate with a specific surface area of 1.5 to 2.5 $m^2/g$ in a proportion of 5 to (95S-137.5)% by weight ("S" represents a specific surface area ($m^2/g$) of natural ground calcium carbonate.), and adhesive of either alkali-sensitive synthetic resin emulsion or a mixture of alkali-nonsensitive synthetic resin emulsion and viscosity increasing agent(s). The coating composition (B) comprises pigments containing natural ground calcium carbonate with a specific surface area of 2.5 to 5 $m^2/g$ in a proportion of 5 to 100% by weight, and adhesive of either alkali-sensitive synthetic resin emulsion or a mixture of alkali-nonsensitive synthetic resin emulsion and viscosity increasing agent(s).

13 Claims, 4 Drawing Figures

METHOD OF PRODUCING MEDIUM-GRADE COATED PAPER FOR ROTOGRAVURE PRINTING

BACKGROUND OF THE INVENTION

1. Field of the Invention

The present invention relates to a method of producing medium-grade coated paper for rotogravure printing, the base paper of which contains high-yield pulps. More particularly, it relates to a method of producing medium-grade coated paper for rotogravure printing, which paper, when printed, has fewer gravure dots and reproduction of gravure dots is improved.

2. Description of the Prior Art

Recently the importance of coated paper for printing as a medium for magazines, advertising, catalogs and other publications, is again being recognized. Particularly, the demand for coated paper of grades No. 3, 4 and 5 (hereinafter referred to as "medium-grade coated paper") has been increasing rapidly because of the need of reducing the weight and cost of paper. The trend to lighter weight publication grades is pointed out in various articles, for example, in an article by James P. Hanson, Pulp and Paper magazine, May 1977, pages 74–76. The various grades are identified on page 74. Generally, medium-grade coated paper is widely used in the field of light-weight paper of 45 to 80 g/m$^2$ as compared with high-grade (grade No. 1 or No. 2) coated paper which does not contain high-yield pulps. Therefore, to compensate for the reduction of opacity resulting from the decrease of the basis weight of the paper and to reduce the cost of paper, the base paper of medium-grade coated paper contains one or more of the high-yield pulps set out below in an amount equal to between 5% and 100% by weight of its pulp composition. The high-yield pulps, and the designation of each, are as follows:

| | |
|---|---|
| mechanical pulp | MP |
| stone-ground pulp | SGP |
| pressure stone-ground pulp | PSGP |
| refiner-ground pulp | RGP |
| thermo-mechanical pulp | TMP |
| chemi-mechanical pulp | CMP |
| chemi-thermo-mechanical pulp | CTMP |
| chemi-ground pulp | CGP |
| semi-chemical pulp | SCP |

In many cases, medium-grade coated paper, because of its purposes and applications, is subjected to rotogravure printing or web offset printing, both being high-speed printing. In rotogravure printing, unlike other printing processes such as offset printing and letter press printing, missing gravure dots and defective reproduction of the dots are liable to be seen because the rotogravure printing is a unique printing process of transferring printing ink directly from an intaglio or a cell on a metal roll to the paper. These are serious disadvantages producing unfavorable printing results.

Missing gravure dots, or speckle, is seen both on high-grade and medium-grade coated papers. It is particularly liable to occur on medium-grade coated paper, because high-yield pulps contained in the base paper thereof contain more shives and bundles than chemical pulps. Even their single fiber pieces tend to be rigid owing to their high lignin content, and sufficient smoothness is not obtained even under the pressure conditions in supercalender finishing and gravure printing. Remedies proposed heretofore include methods of removing shives and bundles from high-yield pulps, methods of decreasing long fiber fractions, improvements on gravure inks and improvements on gravure plate making, but none of them have been very successful.

The cause of defective reproduction of gravure dots is as follows: In rotogravure printing, the ink, highly diluted with organic solvent, is transferred from an intaglio or a cell to coated paper surface and therefore the ink spreads on the coated paper surface at the time of transfer. The defective reproduction of gravure dots results in low quality reproduction of the original material. As it is attributable to the basic characteristics of rotogravure printing, no decisive remedies therefor have been obtained as yet.

The inventors have made a study not only of the base paper but also of a coating composition in order to decrease missing gravure dots and improve the reproduction of gravure dots on medium-grade coated paper in rotogravure printing. As a result, the inventors have successfully obtained medium-grade coated paper, on which missing gravure dots are decreased and the reproduction of gravure dots is improved, by comprising the base paper of high-yield pulps having a certain fiber length distribution and by using a coating composition containing certain natural ground calcium carbonate in a limited proportion and synthetic resin emulsion as main adhesive.

BRIEF SUMMARY OF INVENTION

It is an object of the present invention to provide a method of producing medium-grade coated paper for rotogravure printing, which paper, when printed, has fewer missing gravure dots and the reproduction of gravure dots is improved.

This and other objects have been attained by a method which comprises applying a coating composition (A) or (B) to either surface or both surfaces of a base paper, the fiber content of which comprises 10 to 100 parts by weight of high yield pulp(s) and 0 to 90 parts by weight of chemical pulp(s), said high yield pulp(s) being below 30% in 42-mesh fiber fraction content, the fiber fraction analysis being performed in accordance with "Method of Screening Test of Paper Pulp" set forth in JIS P 8207, said coating composition (A) comprising pigments containing natural ground calcium carbonate with a specific surface area of 1.5 to 2.5 m$^2$/g in a proportion of 5 to (95S-137.5)% by weight of the total pigment content, where "S" represents the specific surface area (m$^2$/g) of the natural ground calcium carbonate used, and an adhesive of either alkali-sensitive synthetic resin emulsion or a mixture of alkali-nonsensitive synthetic resin emulsion and viscosity increasing agent(s).

said coating composition (B) comprising pigments containing natural ground calcium carbonate with a specific surface area 2.5 to 5 m$^2$/g in a proportion of 5 to 100% by weight of the total pigment content, and an adhesive of either alkali-sensitive synthetic resin emulsion or a mixture of alkali-nonsensitive synthetic resin emulsion and viscosity increasing agent(s).

Other and further objects and advantages of the invention will appear more fully from the following description.

DETAILED DESCRIPTION

Figure 1:
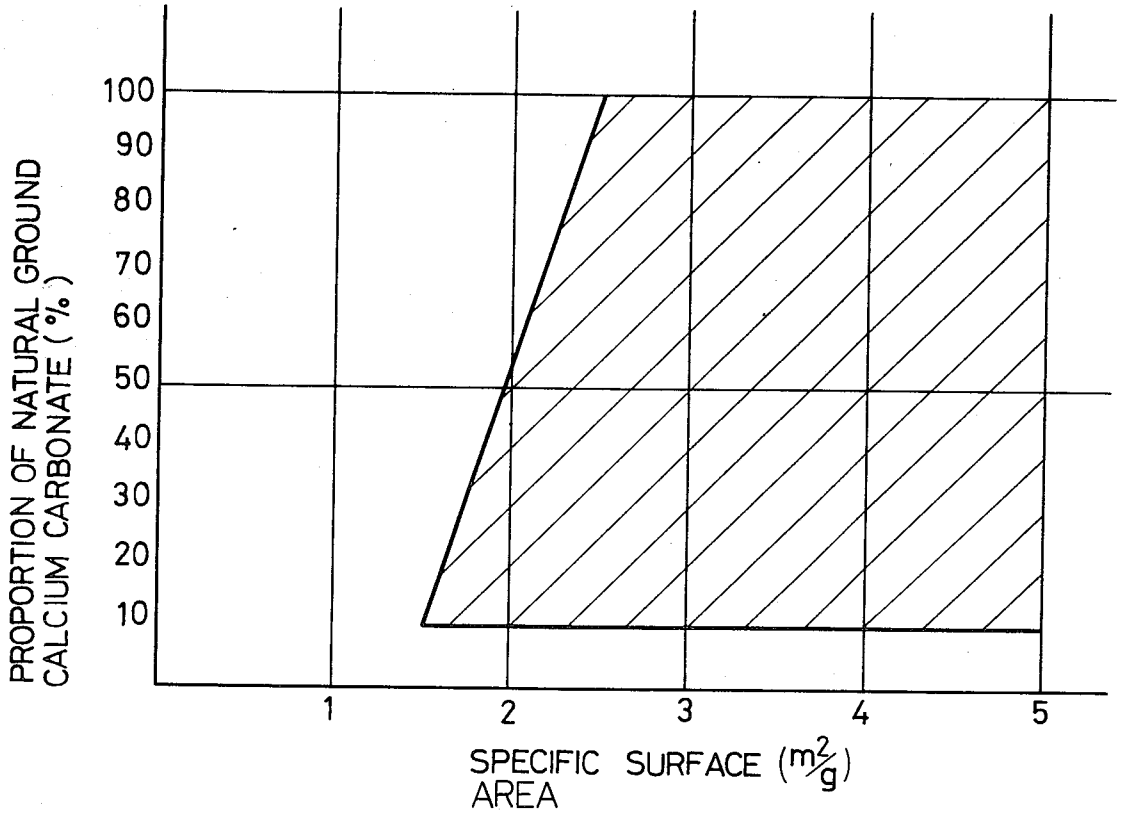
FIG. 1 shows the relationship between the specific surface area of the natural ground calcium carbonate and the proportion, by weight, of said natural ground calcium carbonate to the total pigment content in a coating composition of the present invention.

High-yield pulps used in the present invention are conventional high-yield pulps such as MP (SGP, RGP, TMP ot the like), CMP (CTMP, CGP or the like) or SCP, and consist of unbleached high-yield pulps, semi-bleached high-yield pulps and/or bleached high-yield pulps which are widely used in newsprint paper, paper board, medium-grade paper, medium-grade coated paper, groundwood paper, etc. Selectively used in the present invention are high-yield pulps which, irrespective of their kinds, are below 30%, or preferably below 20%, or more preferably below 10% in 42-mesh fiber fraction content.

The "42-mesh fiber fraction content" of high-yield pulp means the combined total weight of the fiber fraction retained on the 12-mesh screen, the 24-mesh screen and the 42-mesh screen, where the fiber fraction analysis of the high-yield pulp is performed in accordance with "Method of Screening Test of Paper Pulp" set forth in JIS P 8207. When a mixture of more than one kind of high-yield pulp is used, the 42-mesh fiber fraction content is determined by screening the mixture of the high-yield pulps.

Of all high-yield pulps usable in the present invention, high-yield pulps with a 42-mesh fiber fraction content of below 5% are the most preferable because they combine with a certain coating composition of the present invention to decrease missing gravure dots very remarkably. However, it is undesirable to make the 42-mesh fiber fraction content too low, because the yield of pulps and machine processing speed are reduced, and additional power rates are required for refining, post refining, etc. Therefore, the 42-mesh fiber fraction content is adjusted according to the content of the coating composition, etc. Conventional high-yield pulps most generally used in paper making have 42-mesh fiber fraction contents as follows: approx. 25 to 40% for SGP, approx. 30 to 60% for RGP, and approx. 35 to 75% for TMP. High-yield pulps used in the present invention are adapted to have a 42-mesh fiber fraction content of below 30% by properly adjusting the manufacturing conditions, refining conditions, screening conditions, post refining conditions, etc. of the high-yield pulps. Part of lignin is sometimes removed from high-yield pulps by oxidation or deoxidization. Because in this case the high-yield pulps become like chemical pulps, missing gravure dots are decreased, but the original objectives of improving opacity and reducing paper cost by using high-yield pulps cannot be attained. Therefore, such treatment is preferably limited to such an extent that the high-yield pulps show brightness of below 80% when determined by means of a Hunter multi-purpose reflectometer, and this applies also to the case of bleached waste paper.

The base paper of medium-grade coated paper used in the present invention contains said high-yield pulps 10 to 100% by weight of the total fiber content and is produced as follows: The high-yield pulps are mixed with chemical pulp, waste paper pulp, broke pulp, etc. and, according to need, with auxiliary agents such as filler, size, retention aid, paper strengthening agent, dyestuff, alum, pitch control agent, anti-foaming agent, etc. Then the thus prepared papermaking furnish, which can be either at an acid pH or alkaline pH, is made into paper by means of a regular single-wire or double-wire paper machine. Because a coating composition containing natural ground calcium carbonate is applied in a coating process, alkaline paper making is preferable from a point of view of reutilizing brokes. If necessary, it is possible to apply starch, polyvinyl alcohol, polyacrylamide or the like as a surface size by means of a size press, gate roll coater or the like in the paper making process.

A coating composition of the present invention applied to the base paper thus obtained contains pigments and adhesives as its chief ingredients. The coating composition contains, as a pigment, natural ground calcium carbonate, having a specific surface area of 1.5 $m^2/g$ to 5 $m^2/g$, in a proportion of above 5% by weight, preferably above 10% by weight, of the total pigment content.

This point will now be described in detail. The proportion, by weight, of natural ground calcium carbonate contained, as a pigment, in a coating composition of the present invention, to the total pigment content, is specified as follows according to the specific surface area of the natural ground calcium carbonate. The specific surface area and proportion (to the total pigment content) of natural ground calcium carbonate are selected from the shaded portion in FIG. 1.

(i) When the specific surface area is 1.5 to 2.5 $m^2/g$; 5 to (95S-137.5)%, by weight, of the total pigment content ("S" represents a specific surface area ($m^2/g$).)

(ii) When the specific surface area is 2.5 to 5 $m^2/g$; 5 to 100%, by weight, of the total pigment content.

If natural ground calcium carbonate having a specific surface area of below 1.5 $m^2/g$ is used or if natural ground calcium carbonate having a specific surface area of 1.5 $m^2/g$ to 2.5 $m^2/g$ is used in excess of the aforesaid range, the microscopic smoothness of coated surfaces is affected and missing gravure dots rather increase. Consequently, in the present invention, natural ground calcium carbonate having a specific surface area of above 1.5 $m^2/g$ is used within the aforesaid range. In case of natural ground calcium carbonate having a specific surface area of above 5 $m^2/g$, ink gloss and printed surface strength are reduced, and therefore it is necessary to increase the amount of adhesives in the coating composition. Consequently, in the present invention, natural ground calcium carbonate having a specific surface area of below 5 $m^2/g$ is used.

Natural ground calcium carbonate is made as follows: Limestone, sparite, micrite, marble, calcite, natural chalk or the like is ground into fine particles one to several times by a dry or wet process by mechanical means such as a crusher, pebble mill, hammer mill, micron mill, ball mill, jet mill, attritor, sand mill, attrition mill, etc., and is, as required, classified by air elutriation, hydraulic elutriation, etc., and is further condensed and dried. Natural ground calcium carbonate for paper coating thus obtained in the form of slurry or dry powder is used in the present invention.

Particularly, it is preferable to use natural ground calcium carbonate adapted to satisfy formula (1) below, more preferably formula (2) below, as disclosed in Japanese Patent Laid-Open Publications No. Sho 53-81709, Sho 53-40462, etc., by being mechanically ground by a wet process, either continuously or batch by batch, by means of a sand mill, attrition mill, attritor, agitation mill, etc., with natural or synthetic particles, not exceeding approx. 5 mm in diameter, such as Ottawa sand, glass beads, ceramic beads, silicate beads, zirconium beads, etc., as a medium of grinding, (hereinafter referred to as "sand mill treatment").

$$P \geqq (0.5/N)+N \quad (1)$$

$$P \geqq (0.8/N)+N \quad (2)$$

Where "N" represents the specific surface area ($m^2/g$) before sand mill treatment, and "P" represents the specific surface area after sand mill treatment.

A coating composition containing such natural ground calcium carbonate adapted, by said sand mill treatment to have a specific surface area above 2 $m^2/g$ is excellent in fluidity and water retention, and free from streaks, and even if such natural ground calcium carbonate is used in a high proportion of above 20% by weight of the total pigment content, the advantages of decreasing missing gravure dots and improving the reproduction of gravure dots are maintained.

Pigments contained, along with said natural ground calcium carbonate, in the coating composition of the present invention may be conventional pigments for paper coating such as kaolin, clay, barium sulfate, precipitated calcium carbonate, aluminum hydroxide, satin white, titanium dioxide, calcium sulfite, zinc sulfate, plastic pigment, etc., mixed according to their respective properties. It is to be understood that these are merely by way of example and pigments used in the present invention are not limited to those listed.

The coating composition of the present invention contains either alkali-sensitive synthetic resin emulsion, or alkali-nonsensitive synthetic resin emulsion mixed with viscosity increasing agent(s), as the principal adhesive for fixing said pigments to the base paper. Some instances of said alkali-sensitive synthetic resin emulsion are as follows: aqueous dispersion of copolymer consisting of styrene, butadiene or ethylenic unsaturated monocarboxylic acid ester, and ethylenic unsaturated carboxylic acid (German Pat. No. 1919379); aqueous dispersion of copolymer consisting of styrene, butadiene or acrylonitrile, and ethylenic unsaturated carboxylic acid (U.S. Pat. No. 3,409,569); aqueous dispersion of copolymer consisting of conjugated diolefinic unsaturated compound, 5 to 30% by weight, ethylenic unsaturated carboxylic acid, ethylenic unsaturated dicarboxylic acid mono-ester, and other copolymerizable monoolefinic unsaturateed compounds (Japanese Patent Publication No. Sho 49-44948); aqueous dispersion of alkali-soluble copolymer latex obtained by copolymerizing acrylic acid or methacrylic acid and their lower alkyl esters, said copolymer latex being blended with styrenebutadiene copolymer latex (Japanese Patent Publication No. Sho 38-10357) aqueous dispersion of alkali-soluble copolymer latex obtained by copolymerizing acrylic acid or methacrylic acid, their lower alkyl esters, acrylic acid amide or methacrylic acid amide, and styrene or vinyl acetate, said copolymer latex being blended with latex obtained by copolymerizing acrylic ester or methacrylic ester and vinyl ester of monocarboxylic acid (U.S. Pat. No. 3,365,410); aqueous dispersion of alkali-soluble, styrene-butadiene-ethylenic unsaturated carboxylic acid copolymer latex, or vinyl acetate-ethylenic unsaturated carboxylic acid copolymer latex, each copolymerized with above 30% ethylenic unsaturated carboxylic acid, said copolymer latex being blended with styrene-butadiene copolymer latex; and other various alkali-sensitive synthetic resin emulsions which have been known as sole-binder adhesives, as well as aqueous emulsions comprising alkali-sensitive or alkali-soluble synthetic resin emulsion and alkali-nonsensitive synthetic resin emulsion. Among said alkali sensitive synthetic resin emulsions, particularly the alkali-sensitive synthetic resin emulsion containing styrene, butadiene, or ethylenic unsaturated carboxylic acid as its chief ingredient, and the aqueous emulsion of alkali-soluble copolymer latex blended with alkali-nonsensitive styrene-butadiene copolymer latex are preferably used because they help to improve the reproduction of gravure dots and to facilitate the supercalender finishing of coated paper.

Said alkali-nonsensitive synthetic resin emulsion in the present invention is not carboxylated at all or is carboxylated to a low degree, and may be any of various synthetic resin emulsions usually used as adhesives in coating compositions. Some instances thereof are as follows: conjugated diene copolymer latexes such as styrene-butadiene copolymer and methyl methacrylate-butadiene copolymer; acrylic polymer latexes such as polymer or copolymer of acrylic and/or methacrylic ester; and polyvinyl acetate latexes such as ethylene-vinyl acetate copolymer. The viscosity increasing agent(s) used along with said alkali nonsensitive synthetic resin emulsion in the present invention is/are one kind, or more than one kind, of natural or synthetic water-soluble high-molecular compound generally used as viscosity increasing agent, water retention agent, flow modifier or adhesive in coating compositions. Some instances thereof are as follows: sodium alginate; guar gum; cellulose derivatives such as carboxymethyl cellulose, hydroxyethyl cellulose, hydroxymethyl-cellulose and methyl cellulose, water-soluble synthetic resins such as polyacrylate, salt of styrene-maleic acid copolymer, polyvinyl alcohol and salt of isobutene-maleic acid copolymer; starches such as oxidized starch, esterified starch, cationic starch and enzyme modified starch; and proteins such as casein, soybean protein and petroleum protein.

The coating composition used in the present invention contains, as its main adhesives, said alkali-sensitive or alkali-nonsensitive synthetic resin emulsion and viscosity increasing agent(s) as mentioned above. If the proportion of said synthetic resin emulsion to 100 parts pigments by weight is below 3 parts by weight of solids, adhesive force is reduced and water-soluble high-molecular adhesives such as starches and proteins have to be used in quantity. As a result, missing gravure dots are not decreased satisfactorily. If the proportion of said synthetic resin emulsion to 100 parts pigments by weight is above 25 parts by weight of solids, the advantages of decreasing missing gravure dots and improving the reproduction of gravure dots are affected, and coated paper is liable to stick to the rolls at the time of supercalender finishing. Consequently, the proportion of said synthetic resin emulsion to 100 parts pigments by weight is preferably 3 to 25 parts by weight of solids, more preferably 5 to 15 parts by weight of solids.

Said viscosity increasing agent(s) used along with the alkali-non-sensitive synthetic resin emulsion should not exceed said emulsion in proportion by weight of solids. The use thereof in a larger proportion does not help to obtain desired effects of the invention. The proportion of said viscosity increasing agent(s) to 100 parts pigments by weight is preferably 0.01 to 4 parts by weight of solids, more preferably 0.1 to 2 parts by weight of solids.

The coating composition of the present invention containing alkali-sensitive synthetic resin emulsion as its main adhesive is made more viscous generally by being adjusted to have a pH of 7.5 to 13.0 by means of suitable alkaline material, but it is also possible to use said viscosity increasing agent(s), as required, under the same conditions as in the case of alkali-nonsensitive synthetic resin emulsion.

It is possible to mix the coating composition of the present invention, as required, with auxiliary agents such as dispersant, flow modifier, anti-foaming agent, dyestuff, lubricant, insolubilizer and water retention agent to the extent that they do not affect the advantages of the invention.

In the present invention, the base paper is single-coated or multiple-coated on either surface or both surfaces thereof with said coating composition by means of an on-machine or off-machine coater so that a coating weight on one surface is above 2 g/m$^2$, preferably above 5 g/m$^2$ (in terms of solid matter). The makeup of the coating composition on each surface and that of the coating composition forming each layer in multiple coating may be changed suitably. Coating may be done by any process and by means of any of conventional coating machines, for instance, as follows: an air knife coater, roll coater, puddle-type or inverted blade coater with bevel or bent blade, Bill blade coater, twin blade coater and Champflex coater. Among these coating machines, particularly the blade coaters are preferably used because they give smoother coated surfaces.

On the medium-grade coated paper for rotogravure printing of the present invention, missing gravure dots are remarkably decreased, the reproduction of gravure dots is remarkably improved, and excellent paper gloss is obtained. It is not clear why such advantages are obtained, but it seems that the particular base paper combines with the particular coating composition to multiply the advantages. The use of a composition with a sole binder in a coating composition for rotogravure printing paper is disclosed in Tappi Vol. 51 No. 2, p 86A to 91A, Tappi Vol. 50 No. 12 p. 622 to 629, API June 1975 p. 24 to 25, etc. When such a coating composition is used, missing gravure dots are decreased to some extent, but the reporduction of gravure dots is not improved so much as in the present invention. It is surmised that fine natural ground calcium carbonate contained, in a certain proportion, in the coating composition of the present invention helps the absorption of gravure ink solvent in connection, for instance, with the porosity of coats, and contributes to improving the reproduction of gravure dots. In any event, according to the present invention, it is possible to obtain medium-grade coated paper for rotogravure printing, which paper, when printed, has remarkably fewer missing gravure dots and the reproduction of gravure dots is remarkably improved. Particularly when the proportion of natural ground calcium carbonate to the total pigment content is above 20%, by weight, the coating composition has much better fluidity and water retention, and it is possible to obtain, with a very high efficiency, coated paper which has high-degree whiteness and is free from troubles on a blade coater such as streaks, scratches and stalactites.

The present invention will now be described in detail with reference to examples. It is to be understood that the present invention is not limited to the examples. In the examples, "parts" or "%∞ (percent) means "parts" or "%" by weight unless otherwise stated.

EXAMPLE 1

Base paper of 40 g/m$^2$ for medium-grade coated paper was obtained from a paper-making furnish comprising 1 part rosin size, 3 parts alum and 5 parts of talc filler being respectively added to a pulp composition consisting of 15 parts SGP, adapted, by post refining, to have a 42-mesh fiber fraction content of 4%, 65 parts coniferous bleached kraft pulp (hereinafter referred to as "NBKP") having a Canadian Standard Freeness (hereinafter referred to as "CFS") of 550 cc and 20 parts deciduous or hardwood bleached kraft pulp (hereinafter referred to as "LBKP") having a CSF of 450 cc. (The last three "parts" mean parts, by weight, of bone dry pulp.) A coating composition with a concentration of 60% solids was obtained by dispersing 15 parts natural ground calcium carbonate having a specific surface area of 1.6 m$^2$/g ("Super 1700" made by Maruo Calcium Co., Japan) and 85 parts kaolin ("UW-90" supplied by Engelhard Minerals & Chemicals Corporation, USA) in water with 0.2 part sodium polyacrylate as dispersant so as to give a solid matter concentration of 65%, adding thereto adhesives of 0.4 part (solid matter) alkali-soluble acrylic emulsion ("Sterocoll ST" made by Badishe Anilin-& Soda Fabrik AG, West Germany) and 7 parts (solid matter) alkali-nonsensitive acrylic emulsion ("Acronal 500D" made by BASF, West Germany) and adapting the dispersion to have a pH of 9.5 by means of caustic soda. The coating composition was applied to said base paper by means of a blade coater so as to give a dry coating weight (total for both surfaces) of 24 g/m$^2$. Then, the paper was dried, and finished on a supercalender. Thus, medium-grade coated paper of 64 g/m$^2$ was obtained. The medium-grade coated paper was subjected to paper quality tests, the results of which are shown in Table 1.

The specific surface area of the natural ground calcium carbonate was measured as follows by means of a powder surface area tester of the air permeability type (made by Shimadzu-Corp. Japan); A 3 sample was put into a sample tube 1 cm×2 square cm and the specific surface area was calculated from the time required for 20 cc air to pass through it in a 600 mm water column. (In all of the following examples, the specific surface area of natural ground calcium carbonate was measured in this way).

In Comparative Example 1, medium-grade coated paper was obtained in the same way as in Inventive Example 1 except that the proportions of natural ground calcium carbonate and kaolin in the coating composition were changed to 30 parts and 70 parts respectively; 2.5 parts (solid matter) alkali-sensitive emulsion ("Acronal ST425D" made by BASF, West Germany) was used as adhesive; and 3 parts carboxymethyl cellulose (solid matter) was used as viscosity increasing agent. The medium-grad coated paper thus obtained was subjected to paper quality tests, the results of which are shown in Table 1. In Comparative Example 1, the adhesive strength of the coating was too weak, and the rolls of the supercalender and winder were soiled. Therefore, it was impossible to perform continuous operation.

EXAMPLE 2

Base paper for medium-grade coated paper was obtained in the same way as in Example 1 except that the pulp composition consisted of 35 parts RGP adapted to have a 42-mesh fiber fraction content of 9%, 40 parts NBKP having a CSF of 550 cc and 25 parts LBKP having a CSF of 450 cc.

A coating composition was obtained in the same way as in Example 1 except that pigments consisted of 40 parts natural ground calcium carbonate with a specific surface area of 1.9 $m^2/g$ ("Escalon 2000∞ made by Sankyo Seihun KK, Japan) and 60 parts kaolin ("HT Clay" supplied by EMC, USA); and adhesive was 5 parts (solid matter) alkali-sensitive emulsion obtained by blending alkali-soluble copolymer emulsion, consisting of 3 parts methacrylic acid, 5 parts vinyl acetate and 10 parts acrylic acid, with alkali-nonsensitive copolymer emulsion, consisting of 25 parts styrene, 40 parts butadiene, 15 parts methyl methacrylate and 2 parts acrylic acid, in a proportion of 18 to 82 (solid matter). The coating composition was applied to said base paper and dried in the same way as in Example 1. The coated paper was finished by means of a supercalender to obtain medium-grade coated paper. The medium-grade coated paper thus obtained was subjected to paper quality tests, the results of which are shown in Table 1.

In Comparative Example 2, medium-grade coated paper was obtained in the same way as in Example 2 except that the 42-mesh fiber fraction content of RGP was 35%. The medium-grade coated paper thus obtained was subjected to paper quality tests, the results of which are shown in Table 1.

EXAMPLE 3

Base paper for medium-grade coated paper was obtained in the same way as in Example 1 except that the pulp composition consisted of 35 parts TMP adapted to have a 42-mesh fiber fraction content of 9%, 32.5 parts NBKP having a CSF of 550 cc and 32.5 parts LBKP having a CSF of 450 cc. Natural ground calcium carbonate with a specific surface area of 1.5 $m^2/g$ ("Softon 1500" made by Bihoku Funka Co., Japan) was processed to have a specific surface area of 2.1 $m^2/g$ by dispersing it in water by means of a turbine type agitator and with 0.2% sodium polyacrylate as dispersant so as to give a solid matter concentration of 70%, and by grinding the slurry thus obtained by means of a sand grinder (model "32G" made by Igarashi Kikai Seizo Co., Ltd. Japan) at a speed of 1,000 rpm and a flow of 400 liters per hour, and with glass beads of approx 2.5 mm in average diameter as a medium of grinding. A coating composition was obtained in the same way as in Example 1 except that 50 parts natural ground calcium carbonate thus obtained and 50 parts kaolin ("Hydrasheen 90" supplied by Huber Corporation, USA) were used as pigments; 10 parts (solid matter) alkali-sensitive copolymer emulsion consisting of 25 parts methyl methacrylate, 20 parts styrene, 10 parts acrylic acid and 45 parts butadiene, was used as adhesive; and one part oxidized starch ("MS3800" made by Nippon Shokuhin Kako KK, Japan) was used as viscosity increasing agent. The coating composition was applied to said base paper and dried in the same way as in Example 1.

The coated paper was finished by means of a supercalender to obtain medium-grade coated paper. The medium-grade coated paper thus obtained was subjected to paper quality tests, the results of which are shown in Table 1.

In Comparative Example 3, medium-grade coated paper was obtained in the same way as in Example 3 except that pigments in the coating composition consisted of 75 parts natural ground calcium carbonate and 25 parts kaolin; adhesive was 5 parts (solid matter) alkali-sensitive emulsion obtained by blending alkali-soluble copolymer emulsion, consisting of 25 parts metharcylic acid and 8 parts acrylic acid, with alkali- nonsensitive copolymer emulsion, consisting of 35 parts styrene, 30 parts butadiene and 2 parts acrylic acid, in a proportion of 33 to 67 (solid matter); and viscosity increasing was 5 parts (solid matter) oxidized starch ("MS3800" made by Nippon Shokuhin Kako KK, Japan). The medium-grade coated paper thus obtained was put to paper quality tests, the results of which are shown in Table 1.

EXAMPLE 4

Base paper of 35 $g/m^2$ for medium-grade coated paper was obtained from a paper-making furnish comprising 0.5 part rosin size, 3 parts alum, 3 parts of kaolin filler and 0.3 part paper strengthening agent of polyacrylamide resin being respectively added to a pulp suspension consisting of 30 parts TMP adapted to have a 42-mesh fiber fraction content of 25%, 20 parts SGP which was the same as used in Example 1 and 50 parts NBKP which was also the same as used in Example 1.

Natural ground calcium carbonate with a specific surface area of 1.5 $m^2/g$ ("Softon 1500" made by Bihoku Funka Co., Japan) was adapted to have a specific surface area of 2.3 $m^2/g$ by dispersing it in water with a dispersant so as to give a solid matter concentration of 60%, and by treating the slurry thus obtained by means of an attrition mill having silicate beads of approx. 1 mm in average diameter. A coating composition was obtained in the same way as in Example 1 except that 75 parts natural ground calcium carbonate thus obtained and 25 parts kaolin ("UW-90" supplied by EMC, USA) were used as pigments 4 parts (solid matter) alkali-sensitive synthetic resin emulsion, consisting of 31 parts styrene, 31 butadiene, 10 parts methyl methacrylate, 15 parts acrylic acid and 13 parts methacrylic acid, and 8 parts (solid matter) styrene-butadiene copolymer emulsion ("JSR 0696" made by Japan Synthetic Rubber Co., Lts., Japan) were used as adhesives; and 0.05 part (solid matter) carboxymethyl cellulose ("AG Gum" made by Daiichi Kogyo Seiyaku KK, Japan) was used as viscosity increasing agent. The coating composition was applied to said base paper and dried in the same way as in Example 1. The coated paper was finished by means of a supercalender to obtain medium-grade coated paper. The medium-grade coated paper thus obtained was subjected to paper quality tests, the results of which are shown in Table 1.

In Comparative Example 4, medium-grade coated paper was obtained in the same way as in Example 4 except that the pigment in the coating composition consisted of 100 parts natural ground calcium carbonate. The medium-grade coated paper thus obtained was subjected to paper quality tests, the results of which are shown in Table 1.

EXAMPLE 5

Base paper for medium-grade coated paper was obtained in the same way as in Example 1 except that the pulp composition consisted of 20 parts RGP adapted to have a 42-mesh fiber fraction content of 25%, 20 prts NBKP having a CSF of 550 cc and 60 parts LKBP having a CSF of 450 cc. Natural ground calcium carbonate with a specific surface area of 0.1 $m^2/g$ was adapted to have a specific surface of 3 $m^2/g$ by dispersing it in water with 1.0% sodium polyacrylate as dispersant so as to give a solid matter concentration of 70%, and by treating the slurry thus obtained by means of a sand mill. A coating composition was obtained in the same way as in Example 1 except that 100 parts natural ground calcium carbonate thus obtained was used as a pigment, and 2 parts (solid matter) copolymer emulsion, consisting of 20 parts monoisobutylamalate, 30 parts styrene, 40 parts butadiene and 10 parts acrylic acid, and 10 parts (solid matter) copolymer emulsion, consisting of 58 parts styrene, 40 parts butadiene and 2 parts itaconic acid, were used as adhesives. The coating composition was applied to said base paper and dried in the same way as in Example 1. The coated paper was finished by means of a supercalender to obtain medium-grade coated paper. The medium-grade coated paper thus obtained was subjected to paper quality tests, the results of which are shown in Table 1.

In Comparative Example 5 medium-grade coated paper was obtained in the same way as in Example 1 except that pigment in the coating composition consisted of 100 parts kaolin; and adhesives therein comprised 28 parts (solid matter) stryene-copolymer emulsion ("SN-304" made by Sumitomo Naugatuch Co., Ltd., Japan) blended with 0.4 part (solid matter) alkali-soluble acrylic emulsion ("Sterocoll ST" made by BASF, West Germany). The medium-grade coated paper thus obtained was subjected to paper quality tests, results of which are shown in Table 1. When processed in a super-calender, the coated paper had a strong tendency to stick to the calender rolls, and was inferior in workability.

EXAMPLE 6

Base paper for medium-grade coated paper was obtained in the same way as in Example 1 except that the pulp composition consisted of 70 parts SGP adapted to have a 42-mesh fiber fraction content of 5% and 30 parts NBKP having a CSF of 550 cc. Natural ground calcium carbonate with a specific surface area of 0.08 $m^2/g$ was adapted to have a specific surface area of 4.5 $m^2/g$ by dispersing it in water with 0.6% sodium polyacryalate and 0.2% tetrasodium pyrophosphate as dispersants so as to give a solid matter concentration of 73%, and by treating the slurry thus obtained by means of a horizontal type sand mill ("Dynomill" made by Willy A. Bachofen AG, West Germany).

A coating composition with a solid matter concentration of 63%, comprising 100 parts of the natural ground calcium carbonate thus obtained, 5 parts (solid matter) adhesive alkali-sensitive synthetic resin emulsion ("Acronal ST420D" made by BASF, West Germany), some dyestuff, some anti-foaming agent, some insolubilizer and some ammonia, was applied to said base paper by means of a blade coater so as to give a dry coating weight total for both surfaces of 26 $g/m^2$. Then, the paper was dried, and finished on a supercalender to obtain medium-grade coated paper. The medium-grade coated paper thus obtained was subjected to paper quality tests, the results of which are shown in Table 1.

In Comparative Example 6 medium-grade coated paper was obtained in the same way as in Example 2 except that the pigments in the coating composition consisted of 50 parts precipitated calcium carbonate ("PZ" made by Shiraishi Kogyo KK, Japan) and 50 parts kaolin ("HT Clay" supplied by EMC, USA). The medium-grade coated paper thus obtained was subjected to paper quality tests, the results of which are shown in Table 1. In this case, rolls in each process, including supercalender rolls, were soiled, and the workability of the coated paper was very poor.

EXAMPLE 7

Medium-grade coated paper was obtained in the same way as in Example 1 except that the pulp composition consisted of 35 parts RGP adapted to have a 42-mesh fiber fraction content of 15% and 65 parts LBKP having a CSF of 500 cc; pigments in the coating composition consisted of 80 parts natural ground calcium carbonate adapted to have a specific surface area of 2.5 $m^2/g$ by means of an attritor and 20 parts kaolin ("HT Clay"supplied by EMC, USA): adhesives therein consisted of 20 parts (solid matter) methyl methacrylate-butadiene copolymer emulsion ("ML 717" made by Mitsui Toatsu Chemicals Inc., Japan) and 1 part (solid matter) carboxymethyl cellulose; and no caustic soda was added. The medium-grade coated paper thus obtained was subjected to paper quality tests, the results of which are shown in Table 1.

In Comparative Example 7 medium-grade paper was obtained in the same way as in Example 1 except that adhesives in the coating composition consisted of 10 parts (solid matter) methyl methacrylate-butadiene copolymer emulsion ("ML-717" made by Mitsui Toatsu Chemicals Inc., Japan) and 5.5 parts (solid matter) oxidized starch; and no caustic soda was used. The medium-grade coated paper thus obtained was subjected to paper quality tests, the results of which are shown in Table 1.

EXAMPLE 8

Base paper of 50 $g/m^2$ for medium-grade coated paper was obtained from a paper-making furnish comprising 0.05 part size of alkylketene dimer ("Hercon 40" made by Dic Hercules Co., Japan), 0.05 part fixing agent of polyamide epichlorhydrin ("Kymene" made by Dic Hercules Co., Japan), 1.0 part paper strengthening agent of cationic starch and 3 parts filler of natural ground calcium carbonate being respectively added to a pulp suspension consisting of 30 parts SGP adapted to have a 42-mesh fiber fraction content of 20%, 55 parts NBKP having a CSF of 550 cc and 15 parts LBKP having a CSF of 450 cc.

A coating composition was obtained in the same way as in Example 1 except that pigments therein consisted of 60 parts natural ground calcium carbonate whose specific surface area was changed from 1 $m^2/g$ to 4 $m^2/g$ by treatment at a concentration of 65% by means of an attrition mill, 20 parts kaolin ("HT Clay" supplied by EMC, USA) and 20 parts aluminum hydroxide ("Higilite H-42" made by Showa Denko KK, Japan); adhesive therein was 4 parts (solid matter) stryrene-butadiene emulsion ("JSR-0697" made by Japan Synthetic Rubber Co., Ltd., Japan) and viscosity increasing agent therein was 3 parts (solid matter) phosphatic ester starch ("Nylgum M-85" made by Avebe Corp., Holland). The coating composition thus obtained was applied to said base paper and dried in the same way as in Example 1. The coated paper was finished by means of a supercalender to obtain medium-grade coated paper. The medium-grade coated paper thus obtained was subjected to paper quality tests, the results of which are shown in Table 1.

In Comparative Example 8 medium-grade coated paper was obtained in the same way as in Example 1 except that the pigments in the coating composition consisted of 10 parts natural ground calcium carbonate with a specific surface area of 1.3 $m^2/g$ and 90 parts kaloin ("UW-90" supplied by EMC, USA). The medium-grade coated paper thus obtained was subjected to paper quality tests, the results of which are shown in Table 1.

COMPARATIVE EXAMPLE 9

Medium-grade coated paper was obtained in the same way as in Example 1 except that the adhesives in the coating composition consisted of 4 parts (solid matter) styrene-butadiene copolymer emulsion ("JSR-0696" made by Japan Synthetic Rubber Co., Ltd., Japan), 0.3 part (solid matter) carboxymethyl cellulose and 4 parts (solid matter) casein. The medium-grade coated paper thus obtained was subjected to paper quality tests, the results of which are shown in Table 1.

The results of the paper quality tests shown in Table 1 were obtained by visually evaluating medium-grade coated papers printed in accordance with No. 24 m "Method of Testing Gravure Printability of Paper (Method of the Printing Bureau)" of J. TAPPI "Method of Testing Paper Pulp". In Table 1, the results of the paper quality tests are represented by the following four relative grades:

| | |
|---|---|
| □ | Very good |
| O | Good |
| Δ | Poor |
| X | Very Poor |

Figure 2:
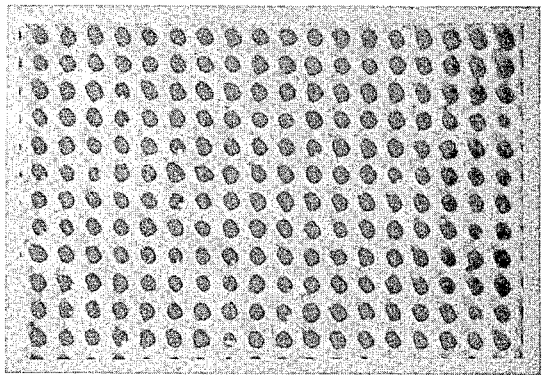
FIG. 2 is a photograph, magnified 40 times, of a gravure-printed surface of coated paper obtained in Example 2.
Figure 3:
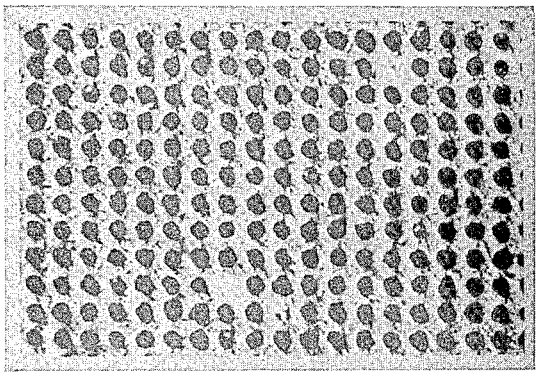
FIGS. 3 and 4 are photographs, magnified 40 times, of gravure-printed surfaces of coated papers obtained in Comparative Examples 1 and 5 respectively.
Figure 4:
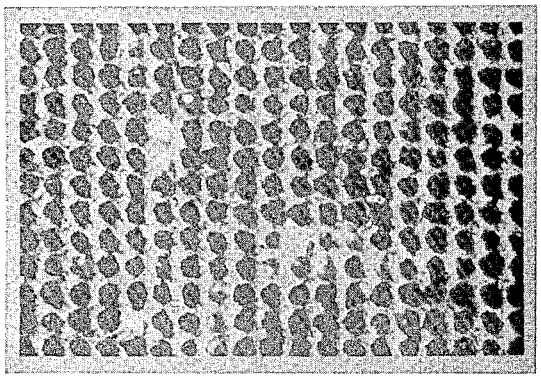

Enlarged photographs (magnified 40 times) of gravure-printed surfaces of medium-grade coated papers respectively obtained in Example 2, Comparative Example 1 and Comparative Example 5 are shown in FIGS. 2, 3 and 4.

TABLE 1

| | Missing Gravure Dots | Reproduction of Gravure Dots |
|---|---|---|
| Example | | |
| 1 | □ | O |
| 2 | □ | □ |
| 3 | □ | □ |
| 4 | O | □ |
| 5 | O | □ |
| 6 | □ | □ |
| 7 | O | □ |
| 8 | O | O |
| Comparative Example | | |
| 1 | X | O |
| 2 | X | □ |
| 3 | X | □ |
| 4 | X | □ |
| 5 | X | X |
| 6 | Δ | □ |
| 7 | X | X |
| 8 | X | Δ |
| 9 | X | X |

Symbols

TABLE 1-continued

| | Missing Gravure Dots | Reproduction of Gravure Dots |
|---|---|---|

□Very good

O Good
ΔPoor
X Very Poor

As seen from Table 1 and FIGS. 2 to 4, paper obtained in each Example of the present invention reproduced gravure dots better and with fewer missing gravure dots than medium-grade coated paper obtained in any Comparative Example, and had well-balanced high quality as medium-grade coated paper for rotogravure printing.

As many apparently widely different examples of the invention may be made without departing from the spirit and scope thereof, it is to be understood that the invention is not limited to the specific examples thereof except as defined in the appended claims.

What is claimed is:

1. A method of producing medium-grade coated paper for rotogravure printing, which comprises applying a coating composition (A) or (B) to either surface or both surfaces of base paper, the fiber content of which comprises 10 to 100 parts, by weight, high-yield pulp(s) and 0 to 90 parts, by weight, chemical pulp(s), said high-yield pulp(s) having a 42-mesh fiber fraction content below 30% by weight.

said coating composition (A) comprising pigments containing natural ground calcium carbonate with a specific surface area of 0.5 to 2.5 $m^2/g$ is a proportion of 5 to (95S-137.5)% by weight of the total pigment content where "S" represents the specific surface area ($m^2/g$) of natural ground calcium carbonate and principal adhesive of either alkali-sensitive synthetic resin emulsion or a mixture of viscosity increasing agent(s) and alkali-nonsensitive synthetic resin emulsion, said coating composition (B) comprising pigments containing natural ground calcium carbonate with a specific surface area of 2.5 to 5 $m^2/g$ in a proportion of 5 to 100% by weight of the total pigment content, and principal adhesive of either alkali-sensitive synthetic resin emulsion or a mixture of viscosity increasing agent(s) and alkali-nonsensitive synthetic resin emulsion.

2. A method as claimed in claim 1, wherein said high-yield pulp(s) is/are below 20% by weight in 42-mesh fiber fraction content.

3. A method as claimed in claim 1, wherein said high-yield pulp(s) is/are below 10% by weight in 42-mesh fiber fraction content.

4. A method as claimed in claim 1, wherein said high-yield pulp(s) is/are below 5% by weight in 42-mesh fiber fraction content.

5. A method as claimed in claim 1, wherein said natural ground calcium carbonate in the pigments contained is said coating cmposition (A) or (B) is above 10%, by weight, of the total pigment content.

6. A method as claimed in claim 1, wherein said natural ground calcium carbonate contained, as a pigment, in said coating composition (A) or (B) is adapted to have a specific surface area of 2 to 5 $m^2/g$ by sand mill treatment.

7. A method as claimed in claim 1, wherein said principal adhesive in said coating composition (A) or (B) is alkali-sensitive synthetic resin emulsion.

8. A method as claimed in claim 7, wherein said alkali-sensitive synthetic resin emulsion contains styrene, butadiene or ethylenic unsaturated carboxylic acid as its chief ingredient.

9. A method as claimed in claim 1, wherein said coating composition (A) or (B) is applied to either surface or both surfaces of said base paper so that its coating weight on one surface is above 2 g/m$^2$ solid matter.

10. Coated paper for rotogravure printing which comprises a paper base having a fiber content comprising 10 to 100 parts by weight of high-yield pulp(s), said high-yield pulp(s) having a 42-mesh fiber fraction content below 30% by weight, said paper base being coated on either or both surfaces with coating composition (A) or (B), said coating composition (A) comprising pigments containing natural ground calcium carbonate with a specific surface area of 1.5 to 2.5 m$^2$/g in a proportion of 5 to (90S-137.5)% by weight of the total pigment content thereof, where "S" represents the specific surface area (m$^2$/g) of natural ground calcium carbonate and principal adhesive of either alkali-sensitive synthetic resin emulsion or a mixture of viscosity increasing agent(s) and alkali-nonsensitive synthetic resin emulsion, said coating composition (B) comprising pigments containing natural ground calcium carbonate with a specific surface area of 2.5 to 5.0 m$^2$/g in a proportion of 5 to 100% by weight of the total pigment content, and principal adhesive of either alkali-sensitive resin emulsion or a mixture of viscosity increasing agent(s) and alkali-nonsensitive synthetic resin emulsion.

11. A coated paper as claimed in claim 10 wherein said high-yield pulp(s) has a 42-mesh fiber fraction content below 20% by weight.

12. A coated paper as claimed in claim 10 wherein said high-yield pulp(s) has a 42-mesh fiber fraction content below 10% by weight.

13. A coated paper as claimed in claim 10 wherein said high-yield pulp(s) has a 42-mesh fiber fraction content below 5% by weight.

* * * * *